US005694721A

United States Patent [19]

Haddock

[11] Patent Number: 5,694,721

[45] Date of Patent: Dec. 9, 1997

[54] MOUNTING ASSEMBLY FOR BUILDING SURFACES

[76] Inventor: Robert M.M. Haddock, 8655 Table Butte Road, Colorado Springs, Colo. 80908

[21] Appl. No.: 335,987

[22] Filed: Nov. 8, 1994

Related U.S. Application Data

[63] Continuation of Ser. No. 91,176, Jul. 13, 1993, Pat. No. 5,483,772, which is a continuation-in-part of Ser. No. 912,845, Jul. 13, 1992, Pat. No. 5,228,248.

[51] Int. Cl.[6] ..... E04D 13/10

[52] U.S. Cl. ..... 52/24; 52/25; 52/542; 52/745.1; 52/745.12; 52/745.13

[58] Field of Search ..... 52/24, 25, 26, 52/745.1, 745.12, 745.13, 542; 181/3, 45

[56] References Cited

U.S. PATENT DOCUMENTS

| | | | |
|---|---|---|---|
| 42,992 | 5/1864 | Howe . | |
| 97,316 | 11/1869 | Rogers . | |
| 106,580 | 8/1870 | Hathorn . | |
| 189,431 | 4/1877 | Creighton | 52/25 |
| 250,580 | 12/1881 | Rogers . | |
| 459,876 | 9/1891 | Powers . | |
| 472,014 | 3/1892 | Densmore | 52/25 |
| 473,512 | 4/1892 | Laird | 52/25 |
| 529,774 | 11/1894 | Baird . | |
| 602,983 | 4/1898 | Folsom . | |
| 756,884 | 4/1904 | Parry . | |
| 939,516 | 11/1909 | Laird | 52/25 |
| 1,054,091 | 2/1913 | Darnall | 52/25 |
| 1,085,474 | 1/1914 | Peterson | 52/24 |
| 1,230,363 | 6/1917 | Baird . | |
| 1,330,309 | 2/1920 | Dixon | 52/24 |
| 2,079,768 | 5/1937 | Levow . | |
| 2,201,320 | 5/1940 | Place . | |
| 4,141,182 | 2/1979 | McMullen . | |
| 5,152,107 | 10/1992 | Strickert . | |
| 5,222,340 | 6/1993 | Bellem . | |

FOREIGN PATENT DOCUMENTS

| | | | |
|---|---|---|---|
| 13076 | 4/1903 | Austria | 52/25 |
| 26329 | 6/1906 | Austria | 52/25 |
| 1215468 | 4/1960 | France . | |
| 2515236 | 4/1983 | France | 52/24 |
| 3728831 | 1/1989 | Germany | 52/24 |
| 204783 | 5/1939 | Switzerland . | |
| 388590 | 6/1965 | Switzerland | 52/24 |

OTHER PUBLICATIONS

Thycurb Catalog, Snow Dam, (unknown publication date).

*Primary Examiner*—Christopher T. Kent
*Attorney, Agent, or Firm*—Sheridan Ross P.C.

[57] ABSTRACT

A mounting device for a building surface. The mounting device includes a mounting body having a slot extending therethrough. This slot may be positioned over/about a standing seam on a metal roof/sidewall and be appropriately secured thereto, such as by the use of blunt-nosed screws which engage the seam material. The mounting device also includes at least one mounting cavity which is adapted to receive an attachment, such as a snow retention device or an interconnector which then engages the attachment (e.g., a frame structure, sign).

24 Claims, 15 Drawing Sheets

MOUNTING ASSEMBLY FOR BUILDING SURFACES

RELATED APPLICATIONS

This application is a continuation of U.S. patent application Ser. No. 08/091,176, filed Jul. 13, 1993, now U.S. Pat. No. 5,483,772 which is a continuation-in-part of U.S. patent application Ser. No. 912,845, filed Jul. 3, 1992, now U.S. Pat. No. 5,228,248, issued Jul. 20, 1993.

FIELD OF THE INVENTION

The present invention generally relates to a mounting device which is attachable to a raised portion of/on a building surface (e.g., roof, wall) and, in one application, to such a mounting device which includes at least one mounting cavity for mounting another member (e.g., snow retention device, frame, sign) thereon for interconnection with the building surface.

BACKGROUND OF THE INVENTION

With the increased use of sheet metal panels in building construction, there has been an increased need to address ways in which various building attachments can be interconnected with a metal panel surface. For instance, there is often a need to attach a sign to the face of a metal panel. Moreover, in the case of metal roofs, there is often a need to mount/secure various types of equipment thereon (e.g., fans, air conditioning units, walkways, signage, facades) via an appropriate frame. In addition, in various climates it may be desirable to position a snow retention device on a metal roof to control/inhibit/impede the movement of snow and/or ice down the pitch of the roof.

Sliding snow and/or ice from roofs can be hazardous to people, the surrounding landscape, property, and building components. For example, snow or ice sliding from a roof above an entryway may injure passers-by. Similarly, falling snow or ice can do damage to landscape features, such as shrubs, and property or building components, including automobiles or lower roofing portions. In addition, sliding snow or ice can shear off antennas, gutters or other components attached to a building roof or wall, thereby potentially causing a leak. The problem of sliding snow or ice is particularly experienced in connection with metal roofs, including raised seam roofs (e.g., standing seam), where there is relatively little friction between the roof and the snow or ice. As used herein, the term "raised seam roofs" includes roofs formed by a series of panels interconnected to define longitudinal, raised portions. It may therefore be desirable to provide a guard suitable for controlling movement of snow and/or ice across/along selected areas of such metal roofs.

Snow guard devices were initially developed for use on tile and shingle roofs. In one type of configuration for use on such roofs, an L-shaped brace has one leg which is fastened to the roof and another leg which projects upwardly from the roof. The fastening leg is typically nailed or screwed into the roof beneath a shingle or tile. By positioning and attaching a plurality of these braces to the roof in substantially linear fashion, linear bars may be positioned within/through one or more receiving areas of the respective upwardly projecting legs to provide a fence-like configuration for snow and/or ice retention. U.S. Pat. No. 97,316 to Rogers, issued Nov. 30, 1869, U.S. Pat. No. 106,580 to Hathorn, issued Aug. 23, 1870, U.S. Pat. No. 250,580 to Rogers, issued Dec. 6, 1881, and U.S. Pat. No. 756,884 to Parry, issued Apr. 12, 1904, are generally representative of this type of device.

A device which employs a similar structure to the above but which does not require the individual braces to actually be affixed to the roof is presented in U.S. Pat. No. 42,972 to Howe, issued May 31, 1864. In this case, the plurality of braces for receiving the linear bars are positioned on opposite sides of the roof and are interconnected by a harness assembly. By positioning the brace/bar assemblies on both sides of the roof, the snow retention device is presumably held in position.

Other snow retention devices for shingle or tile roofs have utilized a more unitary structure. For instance, U.S. Pat. No. 459,876 to Powers, issued Sep. 22, 1891, discloses a snow guard having two laterally displaced spikes which are driven into the roofing surface, with the interconnecting portion of the spikes having a generally V-shaped configuration which extends downwardly toward the roofing surface. U.S. Pat. No. 602,983 to Folsom, issued Apr. 26, 1898, discloses a device used with a tiled roofing surface having grooves formed such that the spikes or leg portions of the device may be positioned therein. An interconnecting portion between the spikes or legs in this instance incorporates a loop-like configuration.

Another snow retention device is the SNOWJAX™ snow guard which is believed to be the subject of U.S. Pat. No. 4,141,182 to McMullen, issued Feb. 27, 1979. This device comprises a plastic barrier having a generally L-shaped cross-section. The device can be installed by smearing the underside of the device with silicon intended to provide a weather seal, positioning the device against the roof surface, and attaching the device to the roof with screws such that the screws penetrate the roofing surface and become anchored into an underlying structural member. An adhesive may be used in place of the screws where desired.

The ThyCurb division of Thybar Corporation has also marketed a snow guard device for use on trapezoidal-type, standing seam roofs having 24 inch wide panels and is believed to be the subject of U.S. Pat. No. 5,152,107 to Strickert, issued Oct. 6, 1992. The device comprises a horizontal steel member which spans one panel width. The horizontal member is fixedly attached at ends thereof to mounting members which straddle the trapezoidal panel ribs. These mounting, members are fastened to the panel ribs by screws.

There are a number of problems generally associated with one or more of the snow guard devices described above. First, such devices may cause the roof to leak. Many of the devices described above are attached to the roof by a screw, nail or other fastener which pierces the roofing surface. Such piercing of the roof can lead to undesired leakage due to inadequate sealing or shearing of the fastener by the forces exerted thereon by sliding snow and/or ice. In an attempt to prevent leakage, sealants and/or gaskets are often applied around the holes pierced through the roofing surface. However, these measures complicate installation and may not fully prevent leaks. Alternative methods for the attachment of snow guard devices to roofs such as adhesive bonding may fail to provide secure attachment and/or may be difficult to install on a sloped surface, particularly where the device is applied to a smooth, non-porous roofing material such as metal.

Many known snow guard devices can also cause undesired pinning of the roofing materials. Metal roofing sheets are often designed to be moveable so as to accommodate normal thermal expansions and contractions. Where snow guard devices such as described above are attached to the roof by a screw, nail or the like which pierces the roofing surface and is anchored into an underlying structural member or deck, the designed thermal movement characteristics of the roof can be compromised, thereby adversely affecting the roof's performance.

The types of snow guard devices described above are also generally not readily adaptable for use in a broad range of raised seam roofing applications. Some of the devices described above are not intended for raised seam roofing applications at all but, rather, are primarily for use on shingled or other non-raised seam roofs. Other known devices are designed for use on raised seam roofs having a particular panel width and seam profile and cannot be easily adjusted for use in connection with panels of differing widths or seams of various profiles. Moreover, some known devices are designed to be permanently connected to a roof such that the device cannot be easily repositioned as may be desired. In addition, known snow guard devices generally comprise a snow blocking element having a height, relative to the roof surface, which is unadjustable, difficult to adjust, or adjustable only between a small range of predetermined positions. Accordingly, the user's ability to adjust such devices, as may be desired to suit particular conditions with respect to snowfall, drifting and the like, is limited.

Based upon the foregoing, there is a need for a mounting device which may be positioned on a metal panel surface without adversely affecting its performance. Moreover, since there are a variety of applications where some type of an attachment is secured to such a metal panel surface, there is a need for a utility mounting device which accommodates for many of such applications.

SUMMARY OF THE INVENTION

The present invention is generally directed toward a utility mounting device which is attachable to a raised portion of/on a building surface, such as to facilitate an interconnection between a member (e.g., snow retention device, frame, sign) and the building surface. Typically, the present invention will be used with a metal roofing or siding surface which is formed by interconnected sheet metal panels which define a certain standing seam configuration at the panel interconnection and in which a base portion is thus positioned between the standing seams at a lower elevation (relative to the upper portion of the standing seam). Consequently, the present invention will be described with regard to such standing seams, although it will be appreciated that all that is required for use of the present invention is a raised portion on a building surface to allow for attachment of the mounting device of the present invention thereto.

In one aspect of the present invention, a mounting device is provided which includes a unitary mounting body, which may be formed from a substantially rigid material, for simplified attachment of the mounting device to the building surface. A slot is formed in and extends through at least a portion of the mounting body and is formed by at least two sidewalls. The slot also has a height, width and a length, the length exceeding at least one of the width and height. Moreover, the slot may be positioned over at least part of the standing seam. In this regard, a securing assembly is also provided for securing at least part of the raised portion within the slot. This securing assembly may include one, but preferably two or more threaded members which extend through the mounting body and one of the sidewalls of the slot to forcibly engage the standing seam between the member(s) and the opposing slot sidewall. Moreover, a cavity (e.g., hole, dimple) may be formed on the opposing sidewall of the slot such that part of the standing seam is deformed therein by the engagement of the threaded member against the opposing surface of the standing seam.

The above-described mounting body may also include a first mounting cavity which is adapted for receiving a member to be interconnected with the building surface (e.g., snow retention device, frame structure, sign) or more typically an interconnector/adapter between the member and mounting body. This mounting cavity is preferably on a surface of the mounting device which itself may be used to provide support (e.g., an upward facing surface). In some applications, it may be desirable to incorporate a second mounting cavity. For instance, in order to accommodate for the use of the mounting device with both vertical and horizontal standing seam configurations (i.e., the general orientation of the upper portion of the seam), it may be desirable for the first and second mounting cavities to assume different (e.g., generally perpendicular) orientations through the mounting body. In this case, a generally upwardly extending mounting cavity can be available for use regardless of the orientation of the mounting device on the standing seam.

Another aspect of the present invention is directed toward a roof assembly which utilizes a mounting device for a roofing surface having the above-described displaced standing seams. In this regard, one mounting device is appropriately secured to one of the laterally-displaced standing seams and another mounting device similarly secured to another of the standing seams. A first member extends between and is interconnected with these mounting devices to control the movement of snow and/or ice down the pitch of the roof along the panel base between the standing seams. In order to further assist in the control of this movement, a second member is attached to and extends away from the first member into engagement with the panel base. In order to allow for adaptation of the second member to a variety of applications (e.g., different roof pitches, where the spacing between the standing seams varies such that it may be desirable to use two or more of the second members between each pair of adjacent standing seams), the second member may be detachably connected to the first member by a snap-fit connector which includes an arcurate cavity and inwardly projecting detent. One orientation which the second member may assume is to extend from the first member in a direction which is generally toward the peak of the roof such that the snow and/or ice will effectively wedge the second member in position against the panel base of the roof.

Another aspect of the present invention is directed toward a roof assembly for a roofing surface having the above-described laterally-displaced standing seams. A first member extends between the displaced standing seams and includes at least one channel portion for receiving a second member. The first member is interconnected with the standing seams by mounting devices such as those described although other types of fasteners may be used. Although this first member may be used to control the movement of snow and/or ice down the roof, it may also be used to provide for color coordination between the roofing surface and the roofing assembly to improve/maintain aesthetics by selecting a second member of a desired color. That is, the second member may actually be cut to size from one of the sheet metal panels and positioned within the first member. In this regard, another member may extend between the mounting devices behind the first member (i.e., more towards the peak of the roof) to primarily provide for the control of movement of snow and/or ice down the pitch of the roof.

BRIEF DESCRIPTION OF THE DRAWINGS

For a more complete understanding of the present invention and further advantages thereof, reference is now made to the following Detailed Description taken in conjunction with the Drawings, in which.

DETAILED DESCRIPTION

The present invention will be described with reference to the accompanying drawings which assist in illustrating the pertinent features thereof. In this regard, the present invention is generally a mounting device which may be positioned upon a building surface (e.g., roof, sidewall) in a desirable manner to provide for a variety of applications, one of which is to control the movement of snow and/or ice down/along a predetermined sloped portion of a roofing surface.

Figure 1:
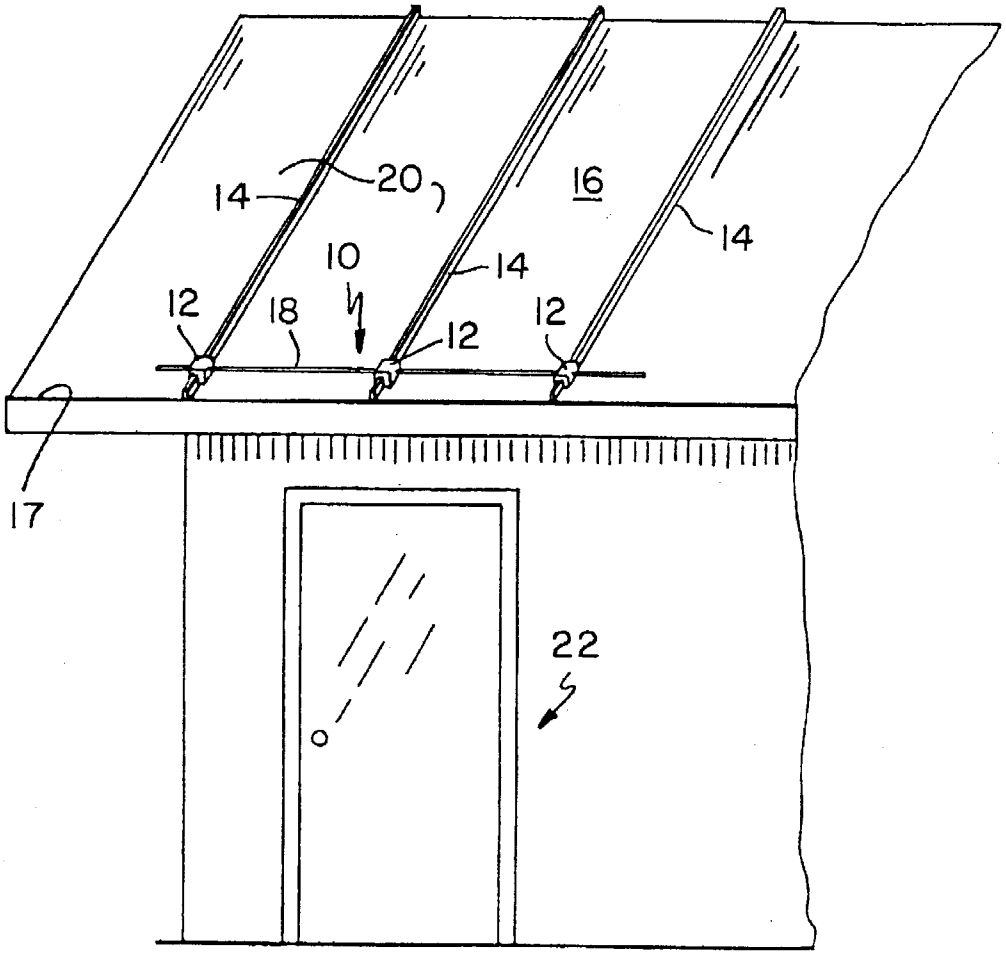
FIG. 1 is a perspective view of an assembly for one application of the present invention.
Figure 2A:
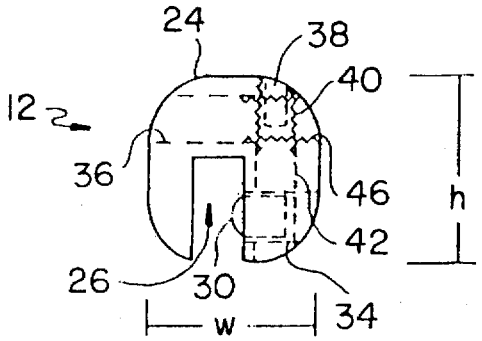
FIG. 2*a* is a front view of a mounting device constructed in accordance with one embodiment of the present invention.
Figure 2B:
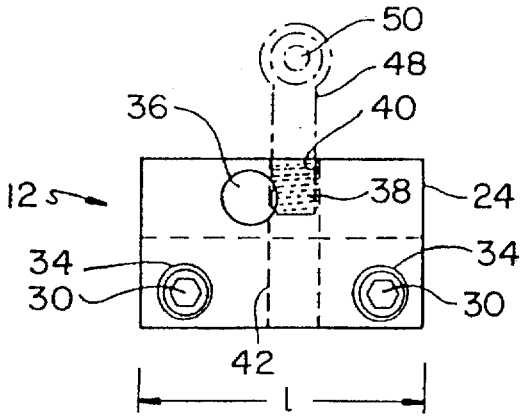
FIG. 2*b* is a right side view of the mounting device of FIG. 2*a;*
Figure 2C:
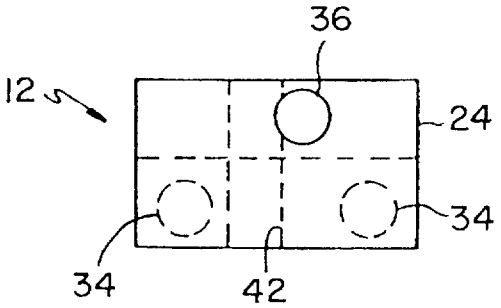
FIG. 2*c* is a left side view of the mounting device of FIG. 2*a;*
Figure 2D:
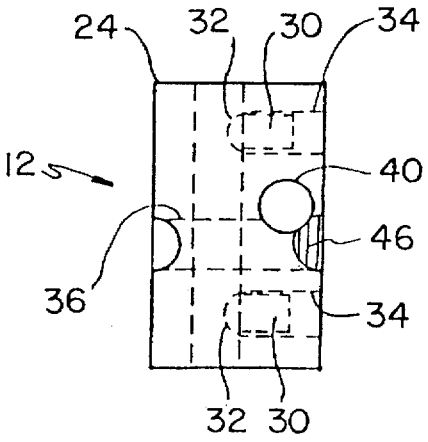
FIG. 2*d* is a top view of the mounting device of FIG. 2*a;*
Figure 2E:
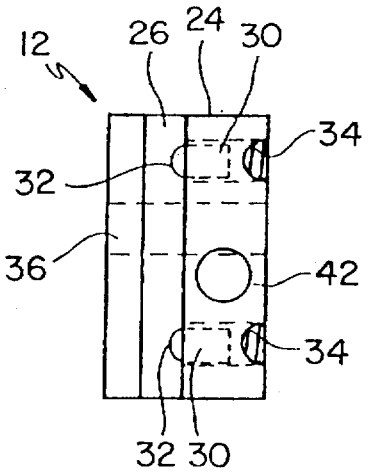
FIG. 2*e* is a bottom view of the mounting device of FIG. 2*a;*

Referring to FIG. 1, a roof assembly 10 utilizes a mounting device of the present invention. Generally, the roof assembly 10 includes at least two mounting devices 12 (three shown and described in more detail below) for attachment to ridges or standing seams 14 of a roof 16 and at least one cross-member 18 spanning between adjacent mounting devices 12. The cross-member 18 controls the movement of snow and/or ice along its respective underlying portion of the roof. More particularly, the movement of snow and/or ice positioned above and aligned with the cross-member 18 is controlled in that the movement of such snow or ice past the cross-member 18 toward the eaves 17 is retarded and/or terminated. As can be appreciated, this may be desirable in a number of circumstances, such as when a sloping portion of the roof 16 is positioned above an entryway 22.

One embodiment of the mounting device 12 which may be used with the roof assembly 10 of FIG. 1 is more particularly illustrated in FIGS. 2*a–e*. Initially, the body 24 of the mounting device 12 may be formed from materials such as various metals, ceramics or plastics based upon, for instance, the particular application. In this regard, the illustrated mounting device 12 is formed from aluminum which provides sufficient load-bearing capability and is also non-corrodible, thus enhancing durability and appearance. As can be appreciated, the aluminum can be anodized to further enhance the appearance of the roof assembly 10. Other metals for forming mounting device 12 are stainless, zinc, copper or brass alloys. The mounting device 12 may also be formed by a variety of methods, one of which is extrusion.

The body 24 of the mounting device 12 generally has a cross-section defined by a longitudinal slot 26 which receives the ridge 14 therein. The edges of the body 24 may be chamfered or rounded if desired to reduce material requirements and enhance the appearance of the roof assembly 10. Moreover, the dimensions of the mounting device 12 can be varied and may be selected to suit particular applications. For example, the depth, width, or shape of the slot 26 can be selected to closely match the profile of the ridges 14 and/or to accommodate for ridges 14 within a predefined range of widths. Furthermore, the body 24 of the mounting device 12 can be dimensioned to allow the cross-member 18 to be positioned a desired distance above the surface of the roof 16. In the illustrated application, the mounting device 12 has a width, w, of approximately 1¼ inches; a height, h, of approximately 1¼ inches; and a length, l, of about 2 inches. Moreover, the slot 26 is about ¾ inches deep (high) and ⅜ inches across (wide). These dimensions have been found suitable for an appropriate range of raised seam roofing applications. In order to provide for a desired degree of stability of the mounting device 12 when attached to a raised portion 14, the length of the slot 26 (which in the illustrated embodiment is equal to the length of the mounting device 12) should exceed at least one of the height of the slot 26 and the width of the slot 26, the length of the mounting device 12 should be at least about 1¼ inches, and/or multiple fasteners (screws 30 with non-piercing ends 32 discussed below) should be used.

It is an advantage of the present invention that the mounting device 12 can be attached to the roof 16 in a manner such that the roof 16 is not pierced. In this regard, the mounting device 12 can be secured to the roof 16 by frictionally engaging external surfaces of the ridge 14 rather than by using a screw, nail or the like which penetrates through the roofing material. For example, this frictional engagement can be accomplished by friction fitting the slot 26 to the ridge 14 and/or by extending at least one protrusion from a wall of the slot 26, after the body 24 has been positioned on the ridge 14, such that the protrusion frictionally engages the ridge 14. In the illustrated embodiment, a pair of set screws 30 are threadably extendible from a wall of the slot 26 and are utilized to engage the ridge 14. The illustrated screws 30, which can have blunt or rounded non-piercing ends 32, frictionally engage the ridge 14, such as by dimpling without penetrating the same. Moreover, the screws 30 force the ridge 14 against the opposing sidewall of the slot 26. Access to the screws 30 is provided through threaded bores 34. Conveniently, the screws 30 can be provided with an allen head dimensioned so that the screw can be hidden within body 24 and yet can be easily adjusted. Based upon this manner of installation, it will be appreciated that the mounting device 12 can be easily repositioned on the ridge 14 as may be desired without leaving holes in the ridge 14 which could cause leakage.

Although two screws 30 are illustrated with regard to mounting device 12 to engage the seam 14 at two displaced locations, it will be appreciated that the actual number used may depend upon a number of factors. For instance, the length, l, of the mounting device 12 may dictate the maximum number of screws 30 which may be employed. However, in order to provide for a secure engagement of the device 12 on the seam 14, preferably two or more screws 30 are used for each device 12.

Figure 3A:
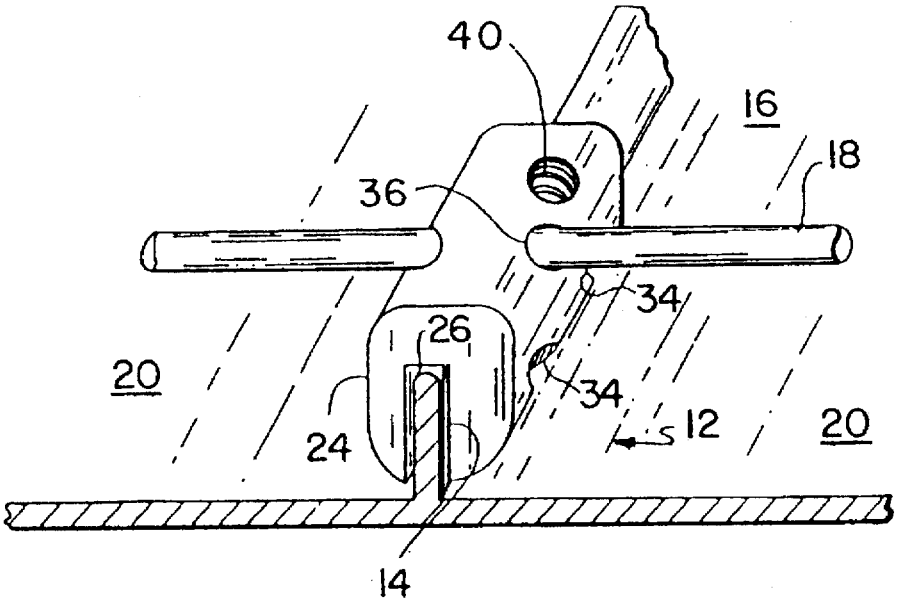
FIG. 3*a* shows the assembly of FIG. 1 installed in a generally vertical configuration.
Figure 3B:
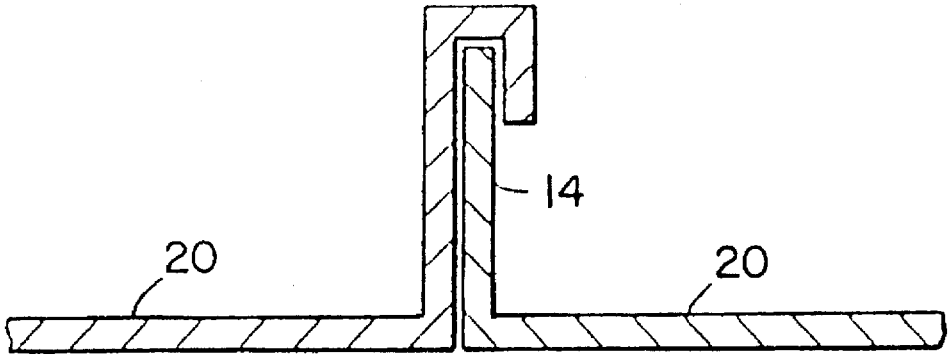
FIG. 3*b* shows a particular raised seam profile on which the assembly of FIG. 1 may be installed in a generally vertical configuration.

Any suitable means may be utilized for interconnecting mounting device 12 and cross-member 18. The illustrated mounting device 12 is provided with openings 36, 42 dimensioned so as to be capable of slidably receiving the cross-member 18 therein when in different positions upon the ridge 14. Moreover, these openings 36, 42 extend through a substantially planar surface of the body 24 of the mounting device 12 which may be used as a supporting surface in certain applications (e.g., when a frame is attached to the mounting device 12, as will be discussed below). With regard to the multiple positionings and as illustrated in FIG. 3*a*, in one particular type of standing seam configuration (only generally illustrated) to define the ridge 14 the cavity 26 of the mounting device 12 extends in a generally downward direction. A common raised seam profile of this type is illustrated in FIG. 3*b*. The cross-member 18 and mounting device 12 can thus be interconnected by sliding the cross-member 18 through the opening 36 (which extends from one side surface of the body 24 to the other side surface above the slot 26 and typically in a direction which would be substantially perpendicular to a plane containing a sidewall of the slot 26) and securing the cross-member 18 to the mounting device 12 with a set screw 38 or the like. The set screw 38 is threaded into a threaded bore 40 which intersects the opening 36 such that the screw 38 contacts the cross-member 18 so as to secure the positioning of the cross-member 18 in the mounting device 12. If desired, an eye bolt 48, shown in phantom in FIG. 2*b*, may be provided in place of the set screw 38, to allow an additional cross-member 50 (phantom) to be provided higher above the panels 20 in a similar orientation to the cross-member 18. Alternatively, only the cross-member 50 need be utilized and such may be positioned through the eye bolt 48. In this case, it can be appreciated that by varying the length of the eye bolt 48, the distance between the panels 20 and the cross-member 50 may be adjusted which may be desirable under certain circumstances. As an alternative to using the eye bolt 48, a cross-member (not shown) of a desired configuration may be directly attached to the upper surface of the mounting device 12 in a suitable manner (e.g., via appropriate threaded connections within the body 24), such as in the case of the cross-members 82', 82" illustrated in use with the roof assembly 52 of FIGS. 5*b* and/or 5*c*.

Figure 4A:
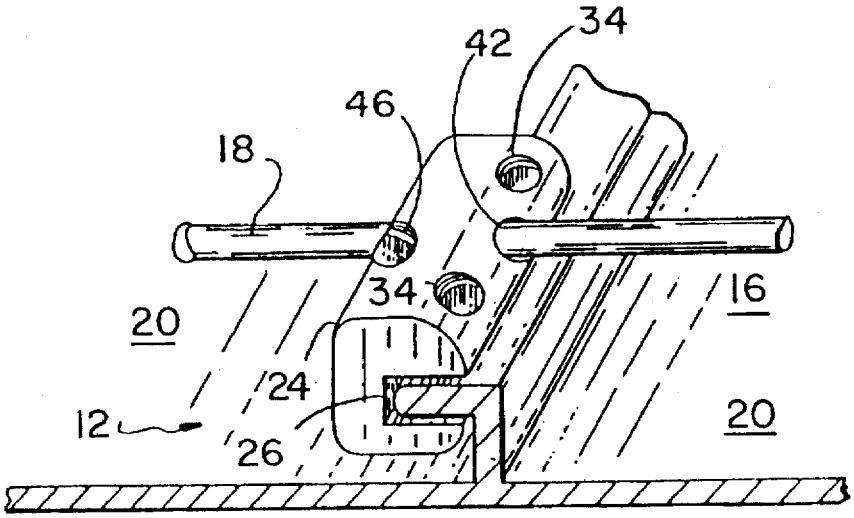
FIG. 4*a* shows the assembly of FIG. 1 installed in a generally horizontal configuration.
Figure 4B:
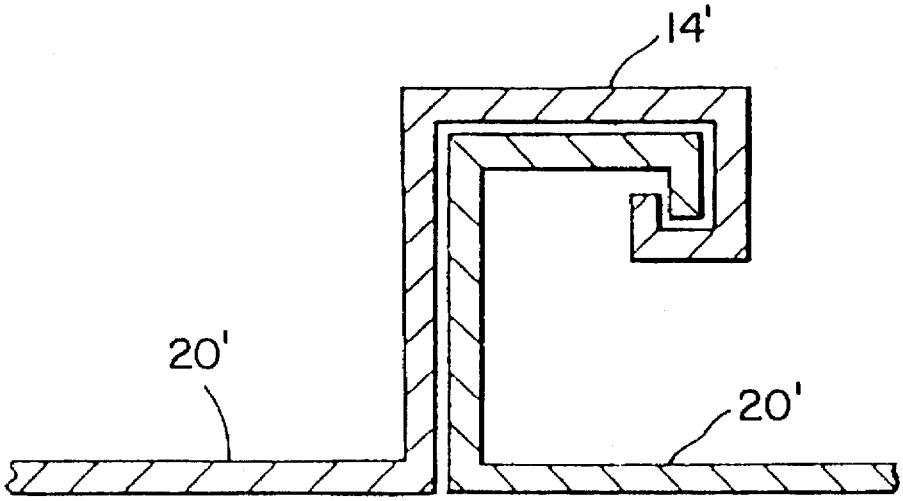
FIG. 4*b* shows a particular raised seam profile on which the assembly of FIG. 1 may be installed in a generally horizontal configuration.

The mounting device 12 may also assume the orientation illustrated in FIG. 4*a* in which the cavity 26 projects in a substantially parallel direction to that of the panels 20. This is utilized in conjunction with another particular type of standing seam configuration 14' which is only generally illustrated in FIG. 4*a*. A common raised seam profile of this type is illustrated in FIG. 4*b*. In this instance, the cross-member 18 is received within the opening 42 (which extends from an upper surface of the body 24 to its lower surface at a location between the slot 26 and a side surface of the body 24, and typically in a direction which is generally parallel with the sidewall of the slot 26) and may be retained therein by a set screw (not shown) positioned within an end portion of the bore 46. It should be noted that bore 40 forms a portion of opening 42. Similarly, bore 46 forms a portion of opening 36. Thus, bore 40/opening 42 and bore 46/opening 36 can be partially threaded as shown. The above-described eye bolt 48 may also be positioned within the bore 46 as in the case of the above-described vertical orientation of the mounting device 12 noted above to provide for the discussed alternatives (not shown).

Based upon the foregoing, it will be appreciated that a primary function of the openings 36 and 42 is to accommodate multiple orientations of the device 12 on a seam 14. Therefore, in providing this function the openings 36, 42 may be spaced on the body 24 instead of being partially intersecting. In this case, a separate set screw cavity (not shown) may be bored through the body 24 of the mounting device 12 to intersect with one of the openings 36, 42 (e.g., by being substantially perpendicular thereto) such that a conventional set screw (not shown) may be used to secure the cross-member 18 to the device 12.

The cross-member 18 can be formed from any suitable material including various metals, ceramics or plastics. The illustrated cross-member 18 is a solid rod formed from aluminum which can be anodized if desired. Other metals may be stainless, zinc, copper or brass alloys. Although various cross-member 18 thickness/diameter may be utilized in accordance with the present invention, the illustrated member has a diameter of about ⅜ inches. Accordingly, bore 40/opening 42 and bore 46/opening 36 can have diameters of about ⅜ inches or slightly more than ⅜ inches so that the cross-member 18 can be slidably received therethrough. The length of the cross-member 18 can be selected, for example, based on the width of the panels, the width of the area across which snow or ice slide protection is desired, or other factors (e.g., a single cross-member 18 may extend through a plurality of mounting device 12, or an individual cross-member 18 may extend only between two mounting devices 12). In this regard, it is an advantage of the present invention that the roof assembly 10 is easily adaptable for use in connection with a variety of roofing applications involving panels of various widths. The cross-member 18 can be received within the body 24 of the mounting devices 12 in the described manner, can be generally straight as shown in FIGS. 3*a* and 4*a*, or can be bent as described below in connection with a further embodiment of the invention so as to allow adjustment of the height of the cross-member 18 over the roof 16. Moreover, a cross-member (not shown) for use alone or in combination with the cross-member 18 may be provided and may be secured to the mounting device 12 by utilizing the threaded bored openings 36/46 or 42/40, or alternatively by field drilling and/or tapping additional holes in the mounting device 12. This cross-member may consist of a variety of geometries other than the rod of the cross-member 18, such as the "L" and "Z" shaped configurations illustrated in FIGS. 5*b* and 5*c* for cross-members 82' and 82", respectively.

Figure 5A:
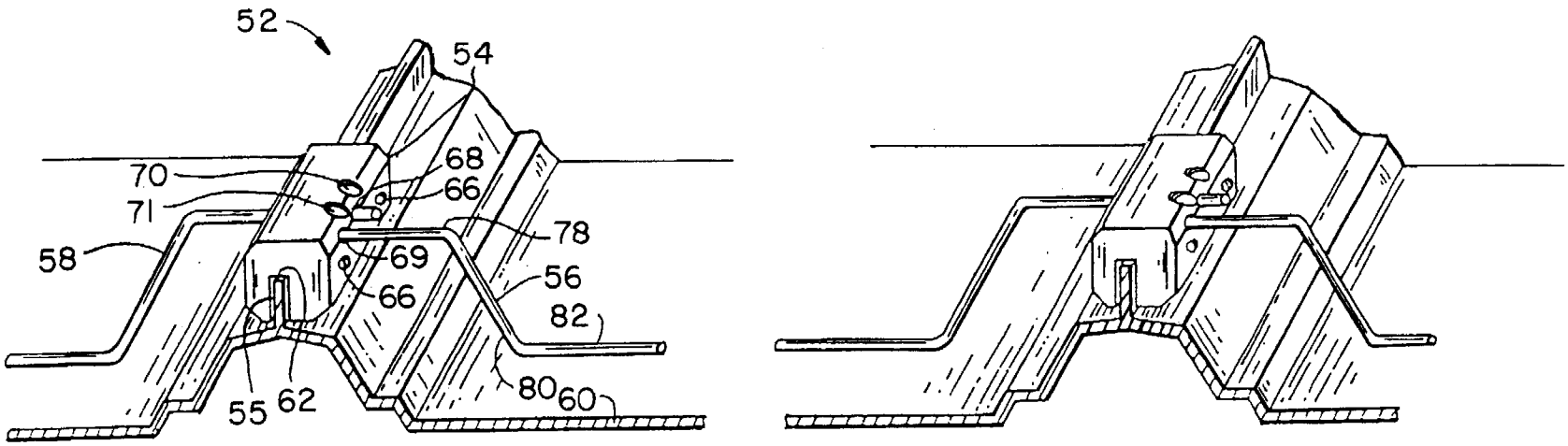
FIG. 5*a* is a perspective view of an assembly for one application of the present invention.
Figure 5B:
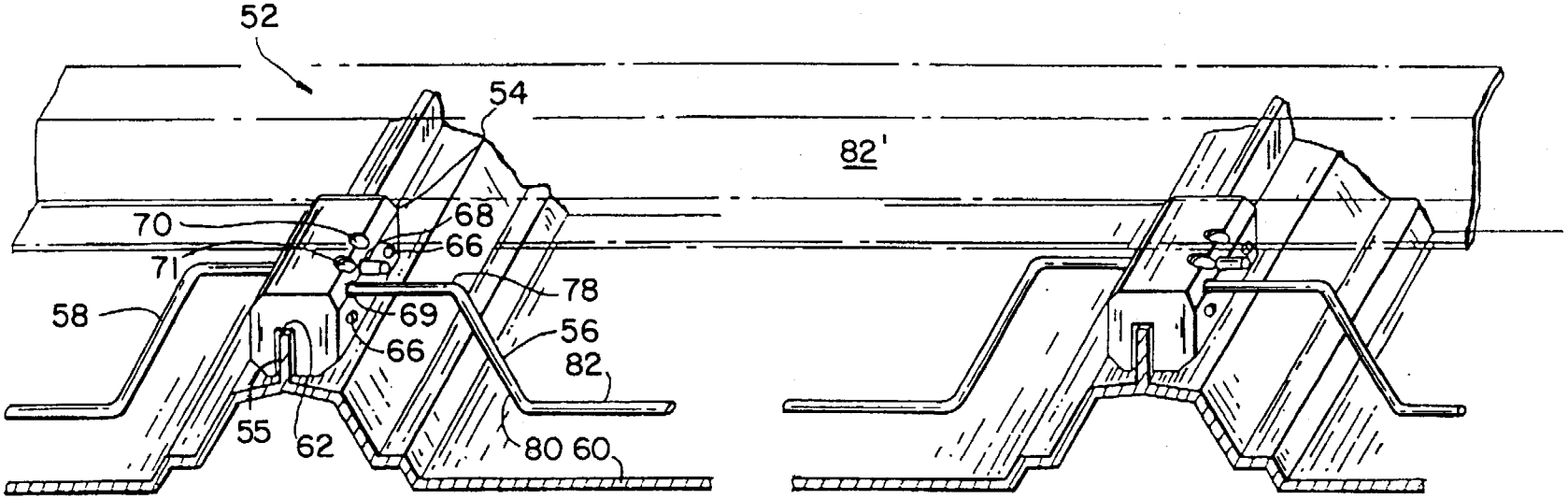
FIG. 5*b* is the assembly of FIG. 5*a* with an additional cross-member of a first configuration utilized therewith.
Figure 5C:
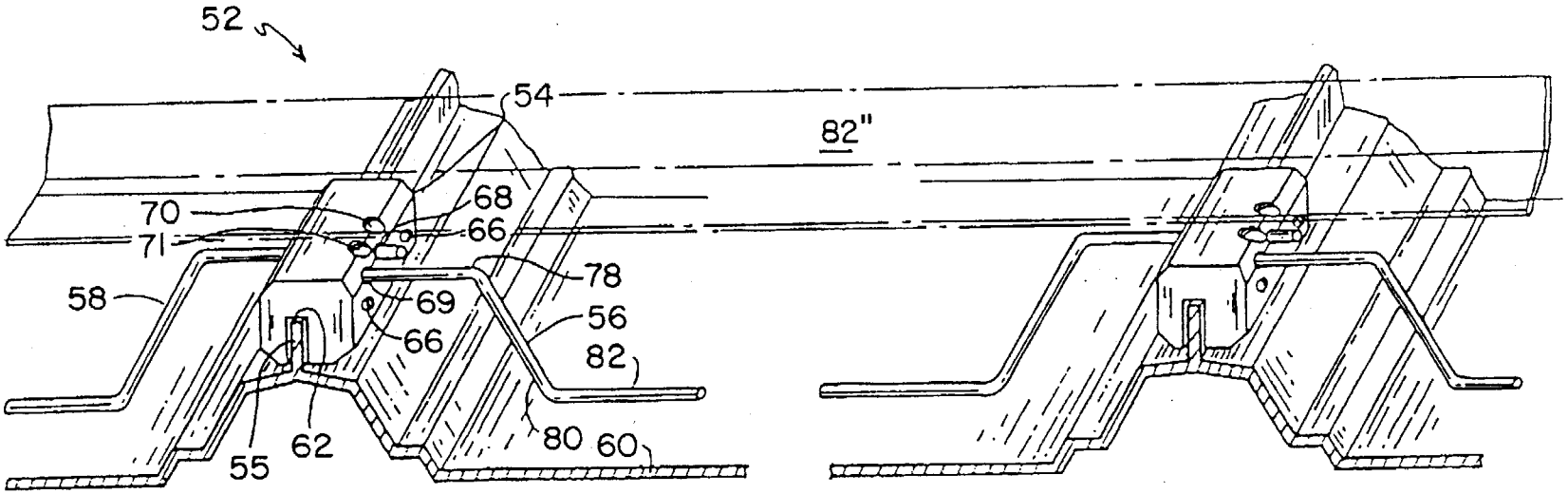
FIG. 5*c* is the assembly of FIG. 5*a* with an additional cross-member of a second configuration utilized therewith.
Figure 6A:
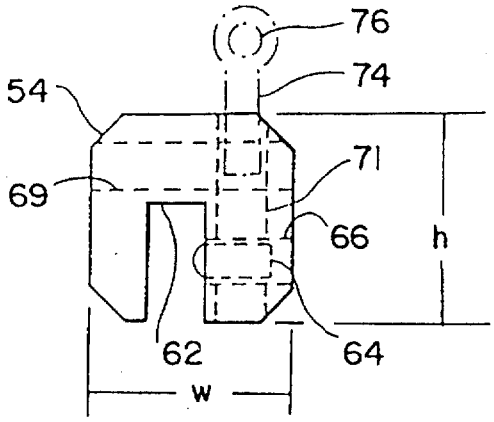
FIG. 6*a* is a front view of a mounting device constructed in accordance with one embodiment of the present invention.
Figure 6B:
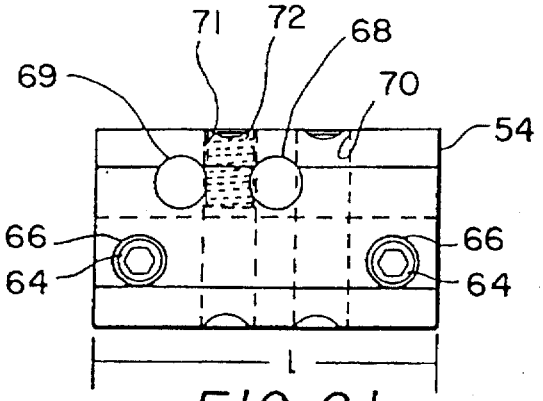
FIG. 6*b* is a right side view of the mounting device of FIG. 6*a;*
Figure 6C:
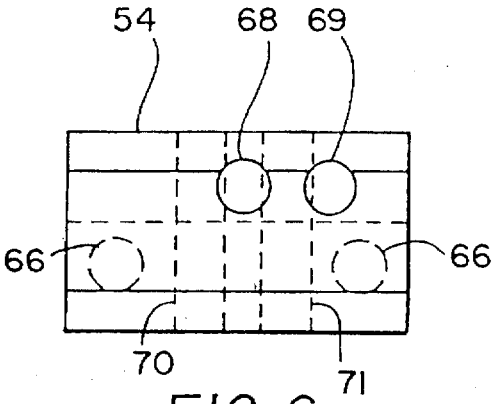
FIG. 6*c* is a left side view of the mounting device of FIG. 6*a;*
Figure 6D:
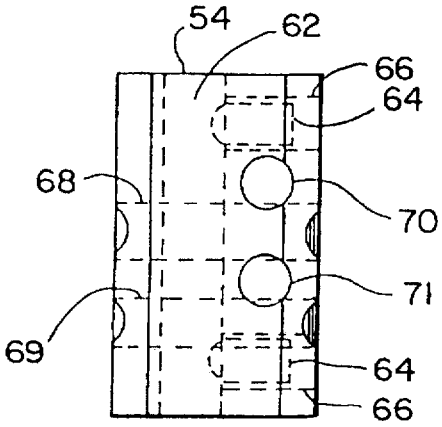
FIG. 6*d* is a top view of the mounting device of FIG. 6*a;*
Figure 6E:
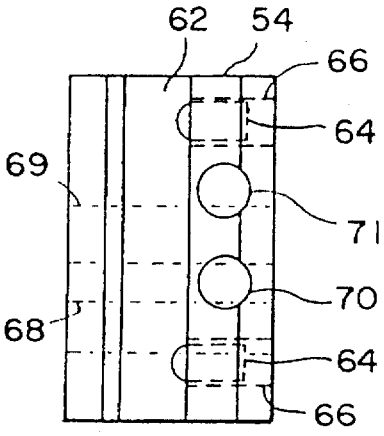
FIG. 6*e* is a bottom view of the mounting device of FIG. 6*a;*

Referring to FIGS. 5–6*e*, roof assembly 52 utilizes a mounting device of the present invention. The roof assembly 52 comprises a number of mounting devices 54 attached to ridges 55 (only two mounting devices 54 being required) and at least one cross-member 56 or 58 positioned above the roof 60 and between the adjacent mounting devices 54. The roof assembly 52 is suitable for use in roofing applications similar to those described above, such as those formed by standing seam interconnections for adjacent panel sections.

The mounting device 54 is similar in many respects to the mounting device 12 described above. The mounting device 54, which may be formed from anodized aluminum and by extrusion, is provided with a slot 62 to receive ridge or standing seam 55. A pair of set screws 64 (similar to screws 30) are threadably extendable from bores 66 into slot 62 to engage, without piercing, ridge 55. As noted above, at least two screws 64 are preferred for attaching each mounting device 54 to a seam 55. Once again, this forces the ridge 55 against the opposing sidewall of the slot 62. However, unlike the mounting device 12 described above, the illustrated mounting device 54 is adapted to simultaneously receive two laterally displaced cross-members 56 and 58.

The mounting device 54 is adapted for use in either a vertical or a horizontal configuration as in the case of the mounting device 12, although only the vertical orientation is illustrated in FIGS. 5*a*–5*c*. Referring to FIGS. 6*a*–6*e*, the mounting device 54 is therefore provided with two side-to-side openings 68 and 69 (oriented similar to opening 36 discussed above) for receiving cross-members 56 and 58 in the vertical configuration (i.e., with the slot 62 projecting down toward the roof 60 as illustrated in FIG. 5) and two top-to-bottom openings 70 and 71 (oriented similar to opening 42 discussed above) for receiving cross-members 56 and 58 in the horizontal configuration (i.e., with the slot 62 projecting substantially parallel to the roof 60 as shown by the mounting device 12 in FIG. 4*a*). In the horizontal configuration, at least one of the side-to-side openings 68 and 69 can intersect at least one of the top-to-bottom openings 70 and 71 so that a set screw 72 can be inserted through the opening(s) 68 and/or 69 to positionally secure the cross-members 56 and 58 in the openings 70 and 71. Similarly, in the vertical configuration, set screw 72 can be inserted through at least one of the openings 70 and 71 to positionally secure the cross-members 56 and 58 within openings 68 and 69. In the illustrated embodiment, opening 68 intersects both openings 70 and 71, and opening 71 intersects both openings 68 and 69, such that a single set screw 72 can be used to secure both cross-members 56 and 58 in either the horizontal or the vertical configuration. Thus, the openings 68 and 71 can be partially threaded as shown. It will be appreciated that an eye bolt or other extension 74 (shown in phantom) can be used in place of set screw 72 to provide for an additional member 76 (phantom) if desired and/or to provide an alternative means for adjusting a distance between the roof 60 and the member 76 (i.e., by varying the length of the eye bolt 74). Moreover, a cross-member 82' of an L-shaped configuration and/or a cross-member 82" of a Z-shaped configuration, as well as other appropriate configurations, may be appropriately attached to the mounting devices 54 (e.g., by using a bolt (not shown) to threadably engage the associated mounting device 54) as illustrated in FIGS. 5*b* and 5*c*, respectively.

As noted above with regard to mounting device 12, a primary function of openings 68/69 and 70/71 is to accommodate for multiple orientations of the device 54 on a seam 55. Consequently, the above-noted intersection of opening 68 with openings 70 and 71 and the intersection of opening 71 with openings 68 and 69 is not required. That is, the openings 68, 69, 70, 71 may be spaced and non-intersecting and set screw holes (not shown) may be separately formed in the device 54 to secure cross-members 54, 56 thereto by conventional set screws if desired.

Although the physical size of the mounting device may be modified to accommodate for a given application, in one embodiment the mounting device 54 has a height, h, of about 1.6 inches; a width, w, of about 1.6 inches; and a length, l, of about 2.5 inches. The slot 62 in this embodiment is about 0.9 inches deep (high) and 0.4 inches wide. The openings 68, 69, 70 and 71 have a diameter of about ⅜ inch. Such dimensions have been found suitable for a broad range of roofing applications. In order to provide for a desired degree of stability of the device 54 when attached to a standing seam 55, the length of the slot 62 (which in the illustrated embodiment is equal to the length of the device 54) should exceed at least one of the height of the slot 62 and the width of the slot 62, the length of the mounting device 54 should be at least about 1½ inches, and/or multiple screws 64 should be used.

It may be desirable to be able to adjust the height of at least a portion of the cross-members 56 and 58 over the surface of the roof 60 to modify the control of snow and/or ice movement. Thus, for example, a variety of openings may be provided in mounting device 54 to allow adjustment of the positioning of cross-members 56 and 58 (not shown), or the cross-members 56 and 58 can otherwise be attached to the mounting device 54 at variable heights. In the illustrated embodiment, cross-members 56 and 58 are provided with bent shapes, defined by substantially horizontal end portions 78, sloping portions 80, and substantially horizontal central portions 82, such that the height of the central portion 82 relative to the surface of the roof 60 can be varied by pivoting or rotating members 56 and/or 58 relative to mounting devices 54. The height of the central portions 82 can thus be adjusted by pivoting or rotating members 56 and 58 until the desired height is achieved and then tightening the set screw 72 to secure the members 56 and 58 in the selected position. In this manner, the height of the central portions 82 can be steplessly adjusted across a broad range of heights. In addition, the central portions 82 can be positioned at heights lower than the mounting devices 54 as shown, such that portions 82 can be positioned close to the surface of the roof 60, as may be desired, even where the mounting devices 54 are attached to relatively tall ridges.

Figure 7:
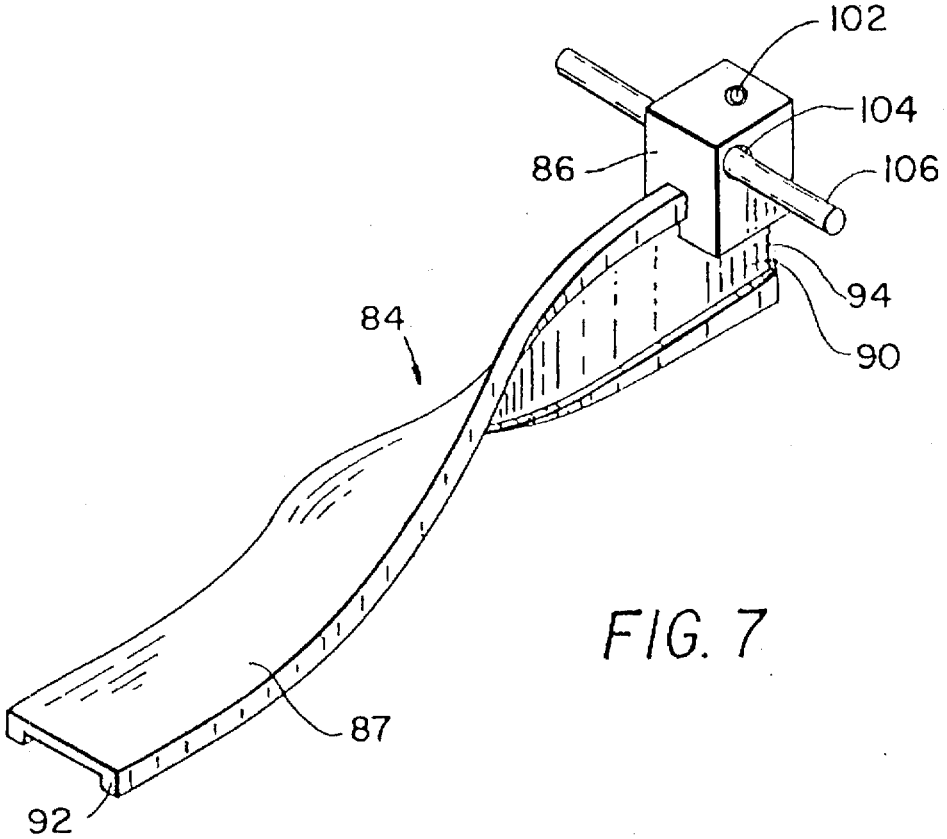
FIG. 7 is a perspective view of an adapter and mounting device constructed in accordance with another embodiment of the present invention.
Figure 8:
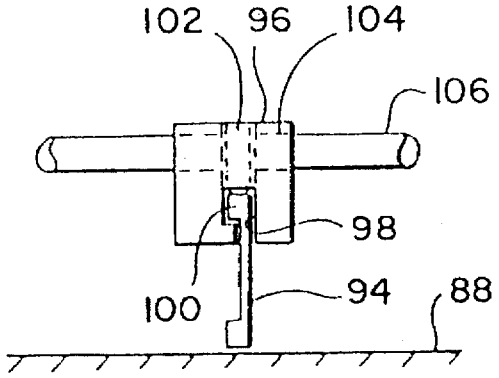
FIG. 8 is a front view of the adapter and mounting device of FIG. 7.

Referring to FIGS. 7 and 8, an adaptor constructed in accordance with the present invention is generally identified by the reference numeral 84. The adaptor can be utilized to allow attachment of a mounting device 86 to, for instance, a roof 88 where a ridge or standing seam is not present. The adaptor 84 comprises a securement portion 87 which lies prone on the roof 88 and a second, raised portion 90 which functions analogously to the ridges/standing seams in the above-described embodiments to provide a surface for attachment of the mounting device 86. In this regard, the adaptor 84 can have a right angle cross-section, e.g., a generally T-shaped or L-shaped cross section, including a base portion for securement to the roof 88 and an upwardly projecting portion. In the illustrated embodiment, the adaptor 82 comprises a twisted aluminum strip having a first, substantially horizontal end 92 and a second, substantially vertical end 94.

The mounting device 86 can comprise an aluminum body 96 having a slot 98 therein for receiving the raised portion 90 of adaptor 84. The slot 98 and raised portion 90 can be provided with complementary shapes. As shown, the slot 98 has a generally "L" shaped cross-section to receive a flanged portion 100 of the adaptor 84. A set screw 102 can be inserted through mounting device 86 to frictionally engage the adaptor 84, thereby securing the mounting device 86 thereto. The mounting device 86 is further provided with an opening 104 for receiving a cross-member 106 such as described above. The mounting device 86 can thus be used to position the member 106 on the roof 88 by attaching the securement portion 87 to the roof 88, e.g., by using an adhesive, nails, screws or the like; securing the mounting device 86 to the raised portion 90 of the adaptor 84; and sliding the cross-member 106 through opening 104 of the adaptor 84. Although the mounting device 86 has been described as such, this alternative installation method may be used with configurations of mounting devices as described above.

Figure 9:
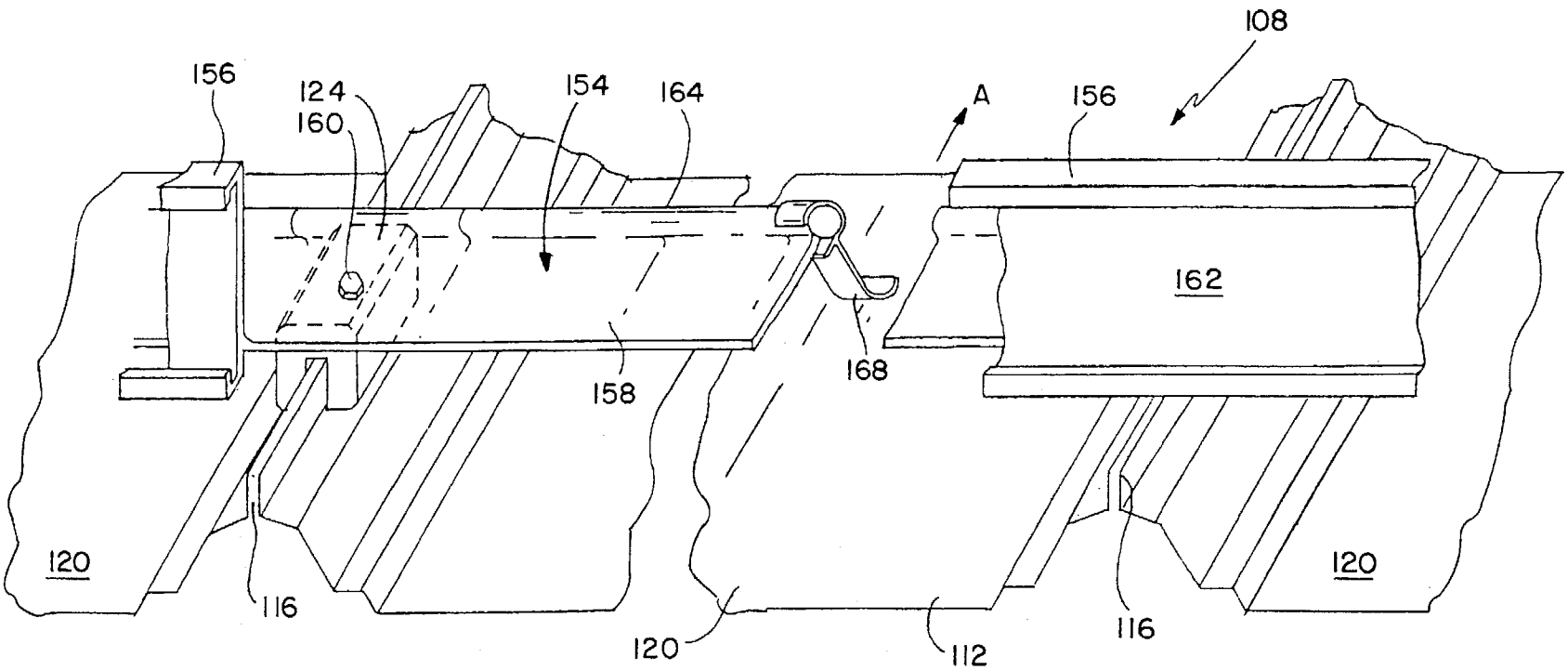
FIG. 9 is a perspective view of an assembly for one application of the present invention.

A roof assembly 108 is illustrated in FIG. 9 and presents another application of the present invention. Generally the assembly 108 is positionable upon a roof 112 having spaced raised portions or standing seams 116 with lower base portions 120 therebetween. The roof 112 will typically be formed from metal sheet panels such that the raised portions 116 are standing seams 116. In FIG. 9, the peak or elevated portion of the roof 112 is in the direction of the arrow A such that the seams 116 run in a generally downward direction away from the peak.

The roof assembly 108 generally includes at least two mounting devices 124 which are attached to displaced standing seams 116, a cross-member assembly 154 which extends between the mounting devices 124, and at least one clip 168 attached to the cross-member assembly 154 for engaging the roof 112 on one of its base portions 120.

Figure 10A:
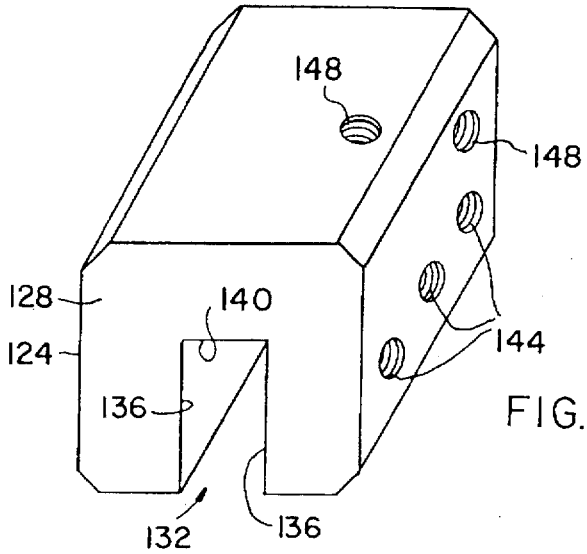
FIG. 10*a* is a perspective view of one embodiment of a mounting device of the present invention.
Figure 10B:
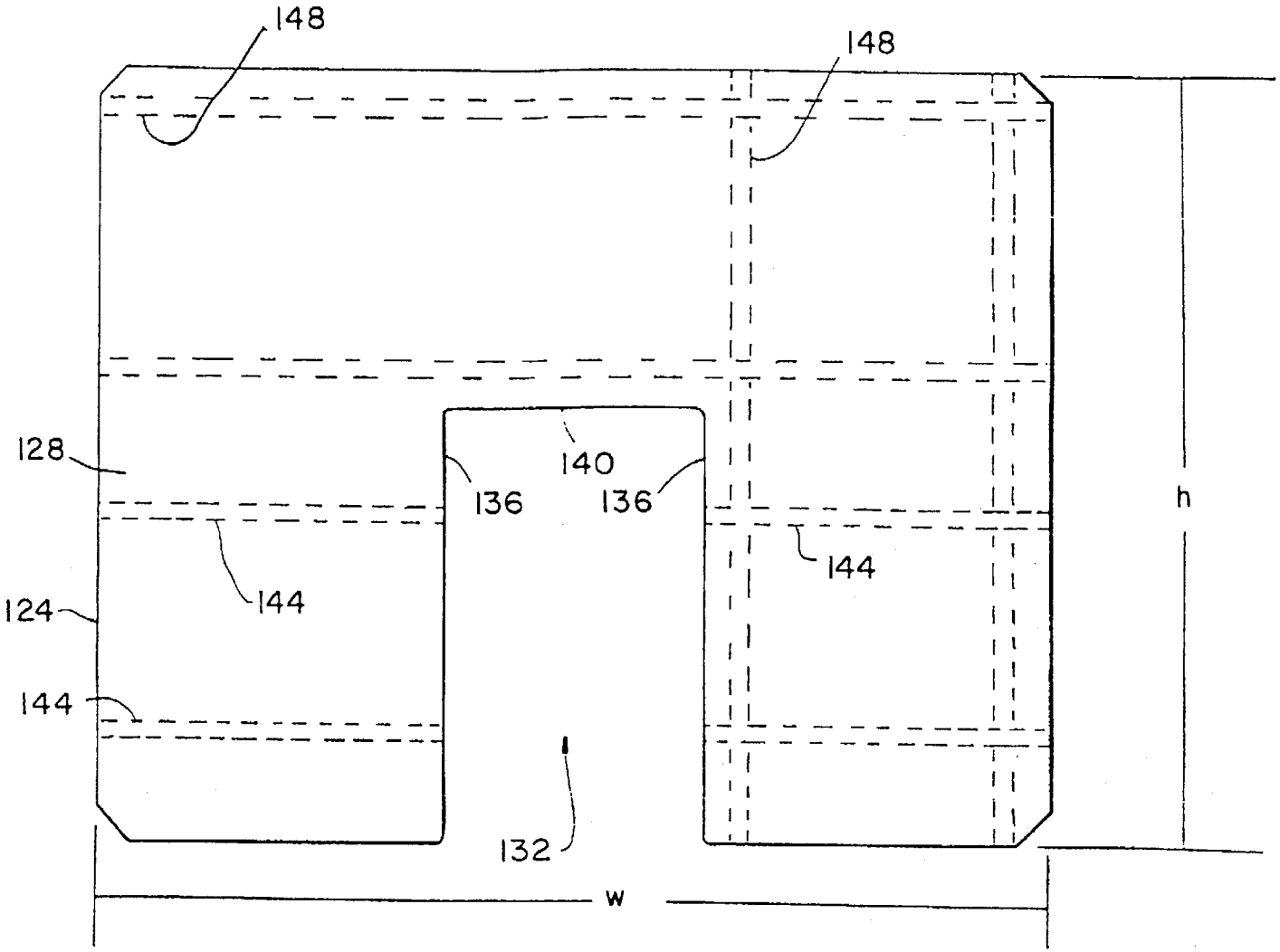
FIG. 10*b* is a front view of the mounting device of FIG. 9.
Figure 10C:
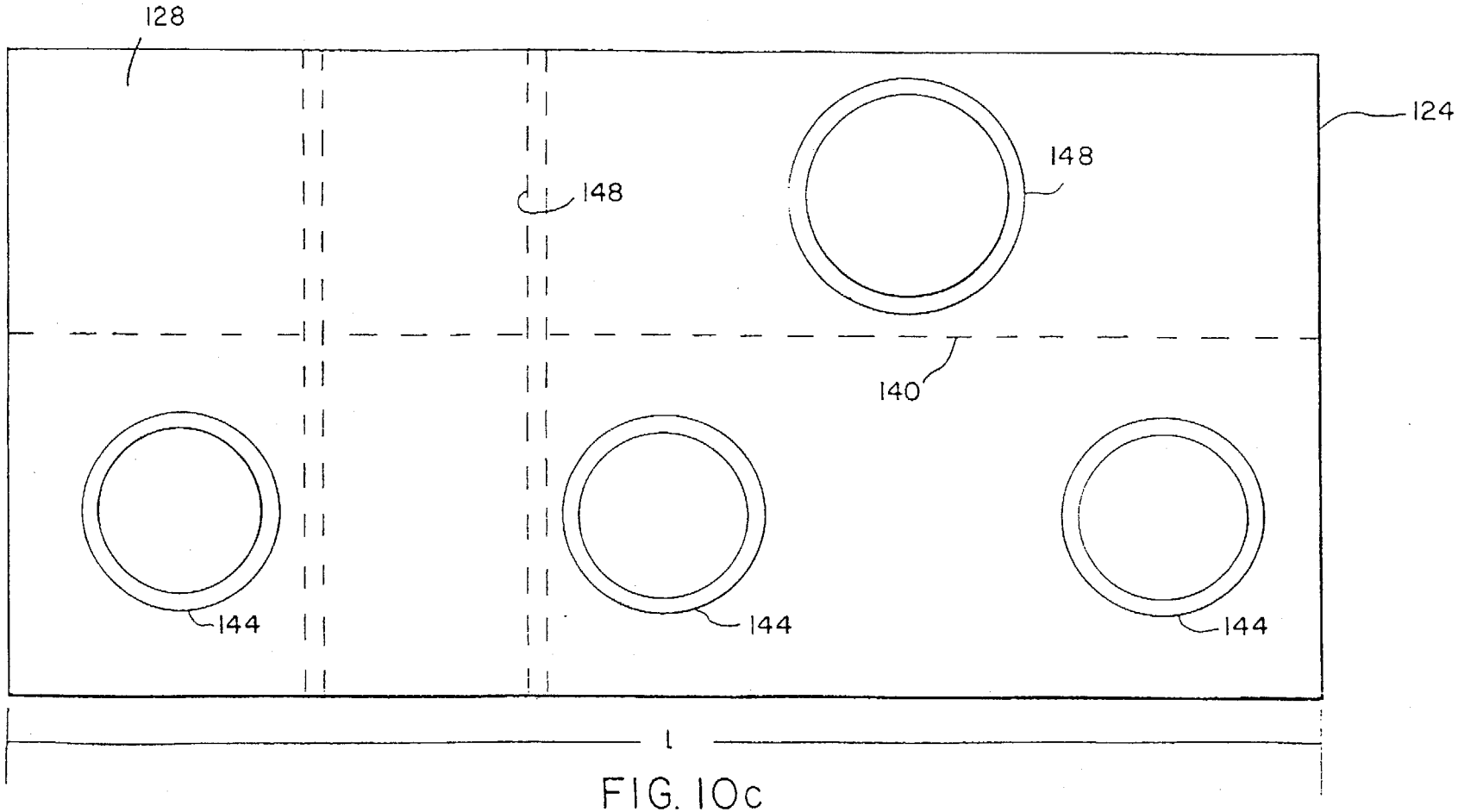
FIG. 10*c* is a right side view of the mounting device of FIG. 10*a;*

One embodiment of the mounting device 124 is more particularly illustrated in FIGS. 10*a*–10*c*. Generally, the mounting device 124 includes a substantially rigid, unitary mounting body 128 (e.g., formed from materials such as aluminum, zinc, brass, stainless steel, and alloys thereof) which may be formed by extrusion. A slot 132 extends longitudinally through the mounting body 128 and is formed by two substantially parallel sidewalls 136 with an integral bottom 140 therebetween. The slot 132 is thus able to be positioned over the top of a standing seam 116 for attachment of the mounting device 124 thereto. Moreover, the position of the sidewalls 136 relative to each other remains substantially constant due to the rigidity of the body 128. Since the function of the slot 132 is to receive the seam 116, other configurations may be utilized for the slot 132.

Figure 11:
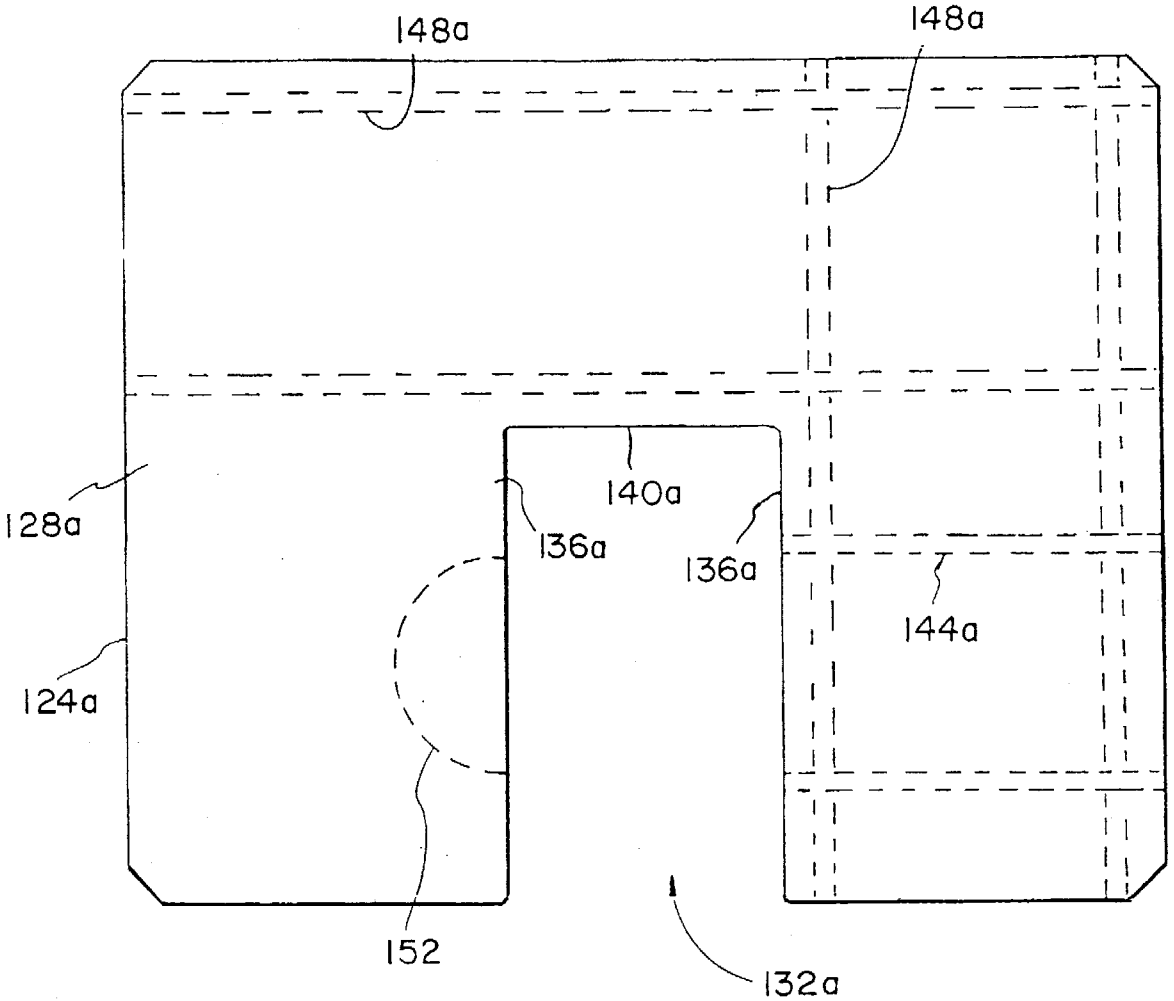
FIG. 11 is a front view of one embodiment of a mounting device of the present invention.

In order to secure the mounting device 124 on a standing seam 116, a plurality of threaded securing bores 144 (three shown although the size of the mounting body 128 may allow for/dictate the use of more or less bores 144) extend through the body 128 from a side of the mounting device 124 to one of the sidewalls 136 which defines the slot 132. In the embodiment of FIGS. 10*a*–*c*, these threaded securing bores 144 are provided in the body 128 on each side of the slot 132 and may include counterbores. Consequently, appropriate fasteners such as the above-described blunt-nosed set screws 30 may be positioned in the threaded securing bores 144 to secure the mounting device 124 on a standing seam 116. One alternative is to use screws 30 in one or more of the threaded securing bores 144 on each side of the slot 132 to secure the mounting device 124 onto the seam 116. However, typically screws 30 are positioned in threaded securing bores 144 on only one side of the slot 132 such that the standing seam 116 will be forcibly engaged between the non-piercing end(s) 32 of the screw(s) 30 and the opposing sidewall 136 of the slot 132 at displaced locations. In this case, portions of the standing seam 116 coinciding with a screw 30 may deform into the threaded securing bore 144 opposing the screw 30 to enhance the securement of the mounting device to the standing seam 116. A similar effect may be achieved with the mounting device 124*a* of FIG. 11 in which a dimple 152 is positioned in linear opposition to a threaded securing bore 144*a*.

The mounting devices 124 also include features which allow for the mounting of various attachments thereon. For instance, the mounting devices 124 each have two threaded mounting bores 148 which may include counterbores (e.g., to provide a shoulder to seat within the mounting body 128 to a degree). These mounting bores 148 extend through the body 128 is different orientations (substantially perpendicular in the FIGS. 10*a*∝*c* embodiment and similarly to openings 36, 42 with regard to the orientation thereof relative to the slot 132) and are positioned on substantially planar surfaces as noted above with regard to openings 36, 42. As noted above, this allows the mounting device 124 to be used with different orientations of a standing seam (e.g., FIGS. 3–4) and this multiple orientation of the threaded mounting bores 148 may also be further desirable for certain applications where multiple attachments may be required.

Although the physical size of the mounting device 124 may be modified to accommodate for a given application, in one embodiment the mounting device 124 has a height, h, of about 1.25"; a width, w, of about 1.500"; and a length, l, of about 2.50". The slot 132 in the embodiment is about 0.70" deep (high), and about 0.40" wide. Threaded mounting bores 148 have a diameter of about 0.375". In order to provide for a desired degree of stability for the mounting device 124 when attached to a seam 116, the length of the slot 132 (which in the illustrated embodiment is equal to the length of the mounting device 124) should exceed at least one of the height of the slot 132 and the width of the slot 132, the length of the mounting device 124 should be at least about 1½ inches and/or multiple fasteners (e.g., blunt nosed screws 30) should be used.

Figure 12:
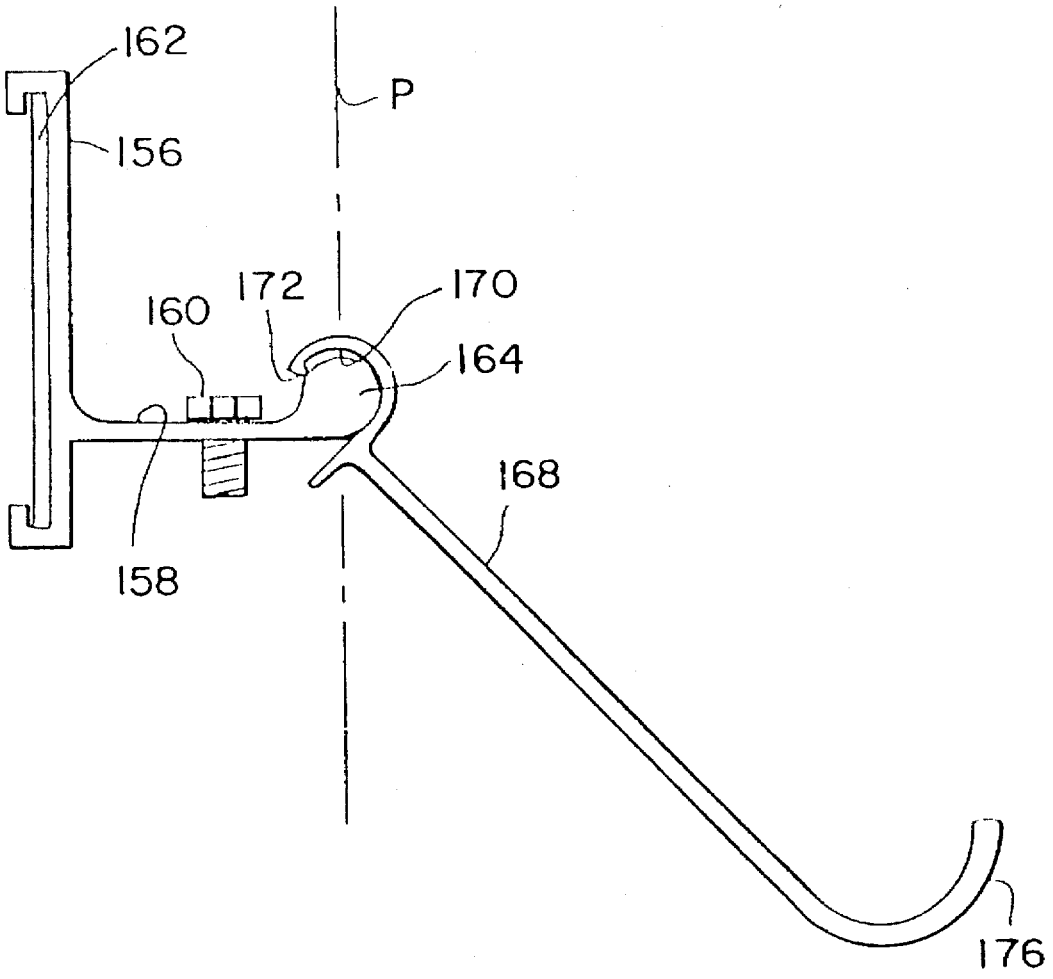
FIG. 12 is an end view of the assembly of FIG. 9.

The cross-member assembly 154 of the roof assembly 108 (FIGS. 9 and 12) is positioned on an exterior supporting surface of the mounting device 124 (e.g., its upper surface in FIG. 9) and is secured thereto by a bolt 160 which is secured within one of the threaded mounting bores 148. Although the use of mounting device 124 is preferred for this interconnection, other fasteners may be employed. The cross-member assembly 154 includes a channel 156, central panel 158, and rod 164. Generally, the channel 156 is longitudinally extending and configured so as to slidably receive an insert 162 which may be color coordinated with the roof 112 to improve upon the aesthetics of the roof assembly 108 (e.g., the insert 162 may be cut to size from a sheet metal panel which forms the roof 112). However, the channel 156 may also contribute to the controlling of the movement of snow and/or ice down the pitch of the roof 112.

The rod 164 is interconnected with the channel 156 by a central panel 158. The central panel 158 actually serves as the interfacing surface between the cross member assembly 154 and the mounting devices 124. Moreover, the rod 164 serves to control the movement of snow and/or ice down the pitch of the roof 112 similar to the various other cross members discussed above. Although the cross-member assembly 154 may be integrally formed by extrusion, the channel 156, central panel 158, and rod 164 may be separate pieces which are appropriately joined together, such as be welding.

In certain applications, it may be desirable to position one or more of the clips 168 between adjacent standing seams 116. In this regard, clip 168 includes an arcuate cavity 170 which may be positioned around at least a portion of the rod 164. A detent 172 projects inwardly toward the cavity 170 and serves to snap-fit the clip 168 onto the rod 164. In order to maintain the clip 168 on the rod 164, the detent 172 should be positioned on the opposite side of a vertical plane P extending through the rod 164 than the peak or elevated portion of the roof 112. Consequently, the clip 168 extends generally from the rod 164 toward the elevated portion or peak of the roof 112 at an angle into engagement with the base panel 120. In order to reduce the potential for roof damage due to this engagement, the clip 168 includes a generally arcuate end 176.

Those skilled in the art will appreciate that various modifications and adaptations of the described embodiments of the present invention are possible. For example, the various mounting devices described above may be used in connection with applications other than the snow or ice movement controlling applications described above. Thus, the mounting devices can be utilized to attach walkways, guy wires, worker safety lines, signs or other building components to a roof, wall or the like having a raised portion, such as by utilizing one or more of the described types of openings (preferably being threaded within the respective mounting device). For instance, the described eye bolts 48 may be positioned on the mounting device 12 to be used as a guy wire or the like, either alone or in combination with the controlled movement of snow and/or ice provided by the cross-member 18. In addition, the snow or ice blocking members described above may be provided as hollow tubes containing a heater element to melt snow or ice on roofs.

Figure 13:
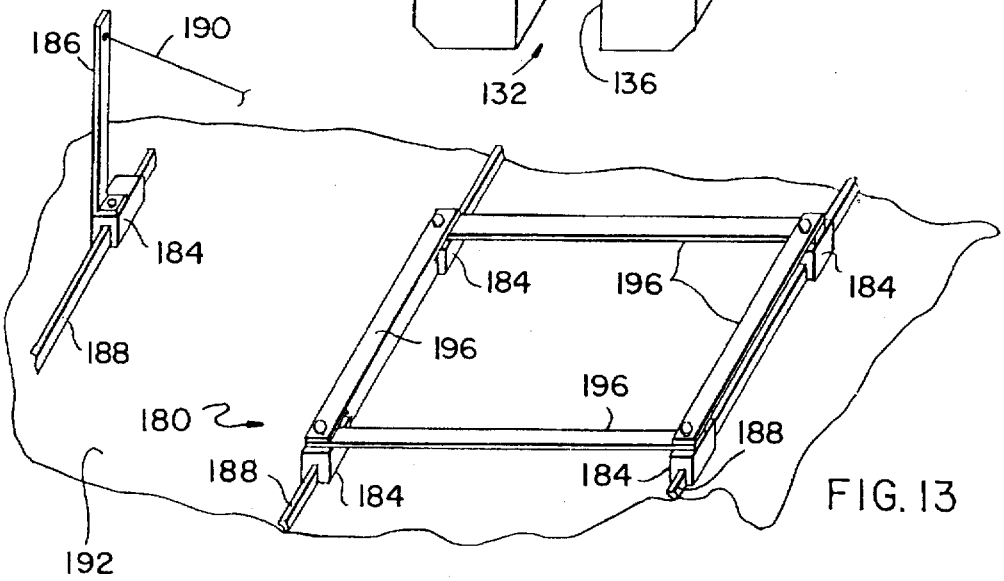
FIG. 13 is a perspective view of an assembly for one application of the present invention.
Figure 14:
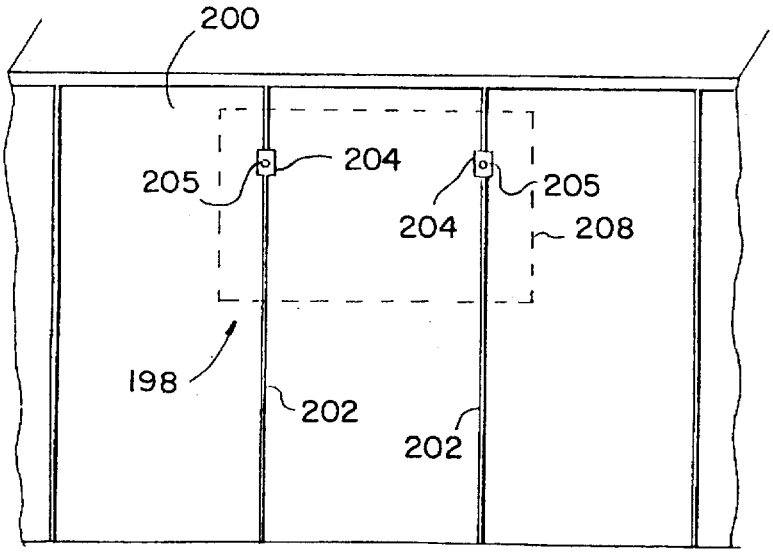
FIG. 14 is a perspective view of an assembly for one application of the present invention.

As an illustration of these other types of applications of the present invention, reference may be made to FIGS. 13 and 14. For instance, the roof assembly 180 of FIG. 13 illustrates that the mounting device 184 (similar to those discussed above) may be positioned on the standing seams 188 of a substantially flat roof 192 such that a frame structure 196 may be constructed thereon for supporting various types of equipment (not shown). In this case, it may be desirable to attach another mounting device 184 to an adjacent standing seam 188 and position an extension 186 thereon (e.g., through one of its threaded mounting bores not shown) such that a guy wire 190 may extend between such equipment and the extension 186.

The siding assembly 198 of FIG. 14 illustrates another application of the present invention. In this case, mounting devices 204 (similar to those discussed above) are attached to the standing seams 202 on a sidewall 200 of a building structure such that a sign 208 may be mounted thereon (e.g. by passing bolts (not shown) through the threaded mounting bores 205 in the mounting devices 204).

Although the present invention has been described with respect to specific embodiments thereof, various changes and modifications, in addition to those cited above, may be suggested to one skilled in the art and it is intended that the present invention encompass such changes and modifications as fall within the scope of the appended claims.

What is claimed is:

1. A roof assembly, comprising:

a sloped roofing surface, said roofing surface extending in a generally downward direction from a peak of said roofing surface;

at least two separate mounting devices interconnected with said roofing surface at two laterally spaced locations;

a first member interconnected with and extending between said at least two separate mounting devices at a location vertically displaced from said roofing surface, said first member having at least one channel portion; and a second member removably received in said at least one channel portion and extending between said at least two separate mounting devices such that said second member, when received in said at least one channel portion of said first member, is removable from said at least one channel portion of said first member and when received in said at least one channel portion of said first member blocks a view of at least a portion of said first member when viewed from a vantage point of looking toward said peak of said roofing surface, said first and second members being disposed between said vantage point and said peak of said roof.

2. An assembly, as claimed in claim 1, wherein:

said at least one channel portion comprises a longitudinally extending channel for slidably receiving and retaining said second member in said channel portion.

3. An assembly, as claimed in claim 1, wherein:

said roofing surface which said at least two mounting devices are positioned, said comprises said peak and extends in a downward slope from said peak toward an edge of said roofing surface;

said assembly further comprising a third member extending between and interconnected with each of said at least two mounting devices at a location vertically spaced from said roofing surface whereby there is an opening between said third member and said roofing surface through which a material may pass down said roofing surface, said third member being positioned between said first member and said peak such that said first member substantially obstructs a view of said third member when said assembly is viewed in a direction from said edge toward said peak.

4. An assembly, as claimed in claim 1, wherein:

said at least two mounting devices each comprise a unitary mounting body and a slot formed in and extending through at least a portion of said mounting body for receiving at least part of one of first and second displaced raised portions on the roffing surface, wherein at least one base portion is disposed between the first and second raised portions at a lower elevation.

5. An assembly, as claimed in claim 1, wherein:

said at least two mounting devices each comprise a fastener.

6. An assembly, as claimed in claim 1, wherein:

said second member is disposed in said at least one channel portion of said first member such that said second member can be slidably removed from said at least one channel portion substantially only in a longitudinal direction of said first member.

7. An assembly, as claimed in claim 1, wherein:

said roofing surface comprises said peak and extends in a downward slope from said peak toward an edge of said roofing surface, wherein said roofing surface further comprises first and second raised portions extending from said peak toward said edge, and wherein said at least two mounting devices each encase at least a portion of one of said first and second raised portions.

8. An assembly, as claimed in claim 1, wherein:

said first member comprises first and second vertically spaced catches which define at least part of said at least one channel portion, said first and second catches engaging first and second vertically spaced edge portions of said second member when disposed in said at least one channel portion of said first member.

9. An assembly, as claimed in claim 1, wherein: said first member is generally C-shaped.

10. An assembly, as claimed in claim 3, wherein: said first member is generally C-shaped and opens in a direction of said edge.

11. An assembly, as claimed in claim 10, wherein:

said first member opens in a direction which is generally parallel with said roofing surface.

12. An assembly, as claimed in claim 1, wherein:

a weight of said first member is substantially supported entirely through said mounting devices.

13. An assembly, as claimed in claim 1, wherein:

said second member is formed from a same material which defines said roofing surface and which is of a same color as said roofing surface.

14. A method for facilitating the mounting of objects on a roofing surface having a downward slope in a direction from an elevated peak of said roofing surface toward an edge of said roofing surface, said roofing surface having first and second displaced raised portions thereon with at least one base portion therebetween said method comprising the steps of:

providing a first mounting device interconnected with said first raised portion of said roofing surface and a second mounting device interconnected with said second raised portion of said roofing surface, said first and second mounting devices having, respectively, first and second mounting locations for interconnecting with an object which would be desirable to mount on said roofing surface;

providing a first member which is extendable between said first and second mounting devices, said first member comprising a channel portion;

interconnecting said first member with said first and second mounting devices such that said first member extends between said first and second mounting devices and such that said channel portion is located between said edge of said roofing surface and said first and second mounting locations of said first and second mounting devices; and providing an insert member removably disposed inside of said channel portion of said first member, such that an object could be interconnected with said first and second mounting devices so that a view of said object would be at least partially blocked by at least one of said first member and said insert member in a viewing direction from said edge of said roofing surface toward said peak.

15. The method of claim 14, wherein:

the method further comprises providing an object extendable between said first and second displaced raised portions; and interconnecting said object, at said first and second mounting locations, with said first and second mounting devices, such that said object would be interconnected with said first and second displaced raised portions of said roofing surface with said insert member located between said edge of said roofing surface and said object.

16. The method of claim 15, wherein:

said object comprises a third member extending between said first and second mounting devices for controlling the movement down said slope of said roofing surface of at least one of snow and ice.

17. A mounting assembly for a building surface, comprising:

first and second mounting devices having a longitudinal extent and interconnectable with the building surface at two laterally spaced locations;

a first member extendable between and interconnectable with each of said first and second mounting devices, said first member having at least one channel portion;

a second member removably receivable in said at least one channel portion of said first member and extendable between said first and second mounting devices, wherein when said second member is received in said at least one channel portion of said first member, said second member is removable from said at least one channel portion of said first member, and wherein when said second member is received in said at least one channel portion of said first member, an uppermost portion of at least one of said first and second members is disposed at a first distance from the building surface and a lowermost portion of said at least one of said first and second members is disposed at a second distance from the building surface which is less than said first distance; and a third member extendable between and interconnectable with each of said first and second mounting devices at a longitudinally spaced location from said first member, wherein an entirety of said third member is disposed at a distance from the building surface which is between said first and second distances.

18. A roof assembly, comprising:

a sloped roofing surface, said roofing surface extending in a generally downward direction from a peak of said roofing surface, wherein said roofing surface comprises said peak and extends in a downward slope from said peak toward an edge of said roofing surface;

at least two separate mounting devices interconnected with said roofing surface at two laterally spaced locations;

a first member interconnected with and extending between said at least two separate mounting devices at a location vertically displaced from said roofing surface, said first member having at least one channel portion;

a second member removably received in said at least one channel portion and extending between said at least two separate mounting devices such that said second member, when received in said at least one channel portion of said first member, is removable from said at least one channel portion of said first member and when received in said at least one channel portion of said first member blocks a view of at least a portion of said first member when viewed from a vantage point of looking toward said peak of said roofing surface; and a third member extending between and interconnected with each of said at least two mounting devices at a location vertically spaced from said roofing surface whereby there is an opening between said third member and said roofing surface through which a material may pass down said roofing surface, said third member being positioned between said first member and said peak such that said first member substantially obstructs a view of said third member when said assembly is viewed in a direction from said edge toward said peak.

19. An assembly, as claimed in claim 18, wherein: said first member is generally C-shaped and opens in a direction of said edge.

20. An assembly, as claimed in claim 19, wherein: said first member opens in a direction which is generally parallel with said roofing surface.

21. A roof assembly, comprising:

a sloped roofing surface, said roofing surface extending in a generally downward direction from a peak of said roofing surface;

at least two separate mounting devices interconnected with said roofing surface at two laterally spaced locations, wherein said at least two mounting devices each comprise a unitary mounting body and a slot formed in and extending through at least a portion of said mounting body for receiving at least part of one of first and second displaced raised portions on the roofing surface, wherein at least one base portion is disposed between the first and second raised portions at a lower elevation;

a first member interconnected with and extending between said at least two separate mounting devices at a location vertically displaced from said roofing surface, said first member having at least one channel portion; and a second member removably received in said at least one channel portion and extending between said at least two separate mounting devices such that said second member, when received in said at least one channel portion of said first member, is removable from said at least one channel portion of said first member and when received in said at least one channel portion of said first member blocks a view of at least a portion of said first member when viewed from a vantage point of looking toward said peak of said roofing surface.

22. A roof assembly, comprising:

a sloped roofing surface, said roofing surface extending in a generally downward direction from a peak of said roofing surface, wherein said roofing surface comprises said peak and extends in a downward slope from said peak toward an edge of said roofing surface, wherein said roofing surface further comprises first and second raised portions extending from said peak toward said edge;

at least two separate mounting devices interconnected with said roofing surface at two laterally spaced locations, wherein said at least two mounting devices each encase at least a portion of one of said first and second raised portions;

a first member interconnected with and extending between said at least two separate mounting devices at a location vertically displaced from said roofing surface, said first member having at least one channel portion; and a second member removably received in said at least one channel portion and extending between said at least two separate mounting devices such that said second member, when received in said at least one channel portion of said first member, is removable from said at least one channel portion of said first member and when received in said at least one channel portion of said first member blocks a view of at least a portion of said first member when viewed from a vantage point of looking toward said peak of said roofing surface.

23. A roof assembly, comprising:

a sloped roofing surface, said roofing surface extending in a generally downward direction from a peak of said roofing surface;

at least two separate mounting devices interconnected with said roofing surface at two laterally spaced locations;

a first member interconnected with and extending between said at least two separate mounting devices at a location vertically displaced from said roofing surface, said first member having at least one channel portion; and a second member removably received in said at least one channel portion and extending between said at least two separate mounting devices such that said second member, when received in said at least one channel portion of said first member, is removable from said at least one channel portion of said first member and when received in said at least one channel portion of said first member blocks a view of at least a portion of said first member when viewed from a vantage point of looking toward said peak of said roofing surface, wherein said second member is formed from a same material which defines said roofing surface and which is of a same color as said roofing surface.

24. A roof assembly, comprising:

a sloped roofing surface, said roofing surface extending in a generally downward direction from a peak of said roofing surface;

at least two separate mounting devices interconnected with said roofing surface at two laterally spaced locations;

a first member interconnected with and extending between said at least two separate mounting devices at a location vertically displaced from said roofing surface, said first member having at least one channel portion and a slope-facing surface; and a second member having slope-facing and peak-facing surfaces, said second member being removably received in said at least one channel portion and extending between said at least two separate mounting devices such that said second member, when received in said at least one channel portion of said first member, is removable from said at least one channel portion of said first member, and when received in said at least one channel portion of said first member, such that at least a portion of said peak-facing surface of said second member is positioned in opposing relation to at least a portion of said slope-facing surface of said first member, overlaps said portion of said slope-facing surface of said first member.

* * * * *